United States Patent [19]

Snethen

[11] 4,133,444

[45] Jan. 9, 1979

[54] FILING SYSTEM

[75] Inventor: Thomas H. Snethen, Dewitville, N.Y.

[73] Assignee: United Business Equipment Corp., Buffalo, N.Y.

[21] Appl. No.: 876,354

[22] Filed: Feb. 9, 1978

[51] Int. Cl.[2] ..... B65D 25/06

[52] U.S. Cl. ..... 220/22.4; 220/22.5

[58] Field of Search ..... 220/22.2, 22.3, 22.4, 220/22.5

[56] References Cited

U.S. PATENT DOCUMENTS

| | | | |
|---|---|---|---|
| 673,403 | 5/1901 | Macey | 220/22.4 |
| 768,716 | 8/1904 | Zimmerli | 220/22.4 |
| 931,978 | 8/1909 | Wiesner | 220/22.4 |
| 1,116,757 | 11/1914 | Stuck | 220/22.4 |
| 1,355,257 | 10/1920 | Peel et al. | 220/22.4 |
| 2,110,610 | 3/1938 | Rickaby | 220/22.5 |
| 2,187,832 | 1/1940 | Link | 220/22.4 |
| 2,746,815 | 5/1956 | King | 220/22.5 |
| 2,877,773 | 3/1959 | Senell | 220/22.5 |
| 3,700,118 | 10/1972 | Snethen | 214/1 R |
| 3,770,159 | 11/1973 | Dunlap | 220/22.5 |

*Primary Examiner*—William Price
*Assistant Examiner*—Joseph Man-Fu Moy
*Attorney, Agent, or Firm*—Bean, Kauffman & Bean

[57] ABSTRACT

A filing system features a novel compressor in combination with a three rod filing tray. The compressor includes a first compressor part having a first bearing means adapted to releasably engage a centralmost of the rods and mounting an anti-tilt bar removably disposed above and to bridge across the rods; a second compressor part pivotally connected to the first compressor part and having a second bearing means normally biased for engagement with the centralmost rod for releasably retaining the compressor in desired position lengthwise of the rods. The compressor parts may be employed to alternately engage with file material arranged adjacent front and rear ends of the tray.

4 Claims, 4 Drawing Figures

FILING SYSTEM

BACKGROUND OF THE INVENTION

Compressor follower devices are conventionally employed in file trays for the purpose of releasably compressing/clamping file material such as cards, checks and other sheets of paper stored in such trays.

A preliminary patent search directed towards the present invention noted the following patents as being of interest:

| Patent No. | Patentee | Issue Date |
|---|---|---|
| 768,716 | C. Zimmerli | Aug. 30, 1904 |
| 1,116,757 | E. Stuck | Nov. 10, 1914 |
| 2,187,832 | F.L.W. Link | Jan. 23, 1940 |
| 2,877,773 | F.R. Sewell | Mar. 17, 1959 |

The above enumerated patents disclosed compressor or follower devices for filing trays characterized in that they are non-removably attached to their associated tray at least throughout their normal range of travel/adjustment, and are not readily adapted for removable attachment with the rods of a three rod type filing tray.

The construction of the tray employed in combination with the compressor of the present invention is disclosed in my prior U.S. Pat. No. 3,700,118, which issued on Oct. 24, 1972.

SUMMARY OF THE INVENTION

The present invention is primarily directed towards an improved compressor or follower device construction particularly adapted for use with a three rod filing tray of the type disclosed in my prior U.S. Pat. No. 3,700,118.

The subject compressor includes a first compressor part having a first bearing means adapted to releasably engage a centralmost of the rods and mounting an anti-tilt bar removably disposed above and to bridge across the rods; a second compressor part pivotally connected to the first compressor part and having a second bearing means normally biased for engagement with the centralmost rod for releasably retaining the compressor in desired position lengthwise of the rods. The compressor parts may be employed to alternately engage with file material arranged adjacent front and rear ends of the tray.

DRAWINGS

The nature and mode of operation of the present invention will now be more fully described in the following detailed description taken with the accompanying drawings wherein.

DETAILED DESCRIPTION

Figure 1:
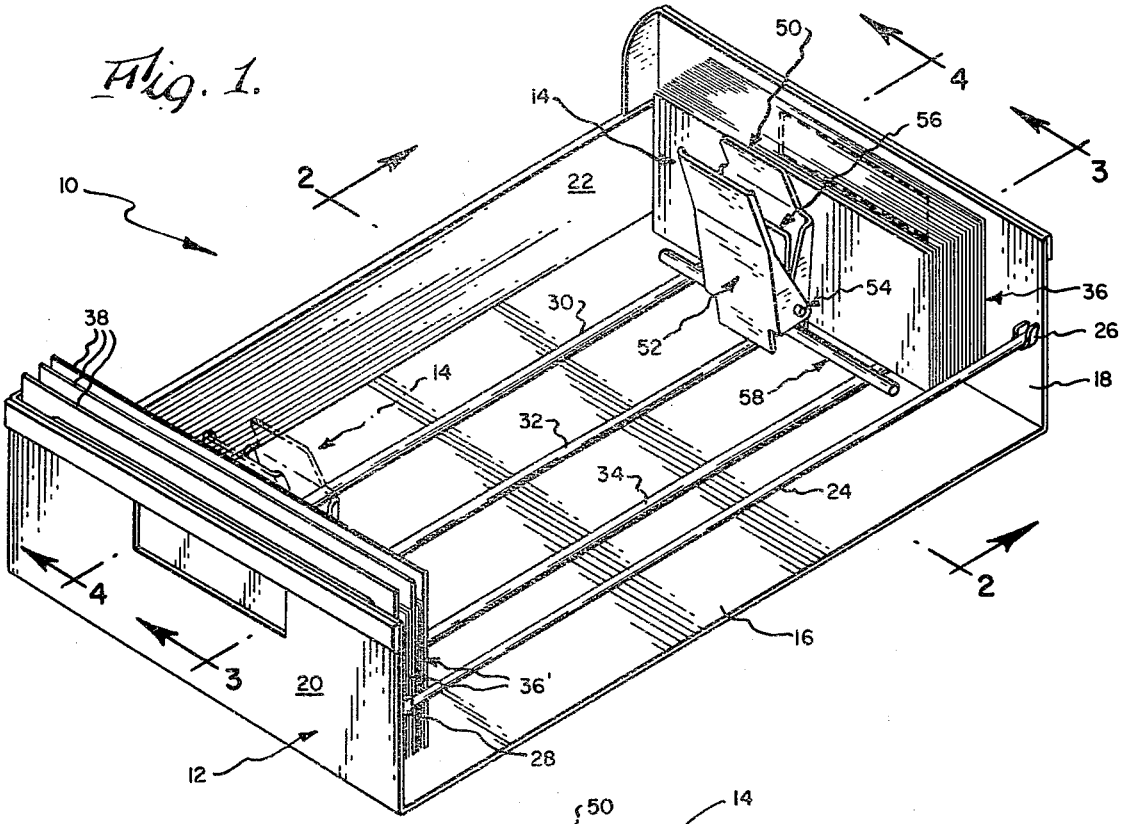
FIG. 1 is a perspective view of a filing system formed in accordance with the present invention.

Reference is first made to FIG. 1, wherein a filing system formed in accordance with the present invention is generally designated as 10 and shown as including a filing tray 12 in combination with a compressor or follower device 14. Tray 12 preferably includes a planar bottom wall 16; rear and front walls 18 and 20, which upstand from adjacent rear and front ends of bottom wall 16, respectively; a stationary side wall 22; a removably supported side wall 24, which may be in the form of a rod or plate releasably supported by rear and front wall mounted securing devices 26 and 28, respectively; and three uniformly spaced, parallel file material support rods 30, 32 and 34, which have their ends supported by mounting plates 40 fixed to the front and rear walls, whereby to position the support rods in a spaced parallel relationship relative to the upper surface of bottom wall 16. As thus far generally described, tray 12 is similar in construction to that described in my prior U.S. Pat. No. 3,700,118.

Tray 12 is particularly adapted for storage of sheet material, such as bank checks, which may be bottom edge supported on support rods 30, 32 and 34 and selectively arranged, either as a non-separated package of checks 36 or as a plurality of groups of sorted checks 36' divided on the basis of account number by appropriate signature or account cards 38. Preferably, signature cards 38 would be formed adjacent their lower edges with slots permitting snap fitting thereof onto support rods 30, 32 and 34. Also, as desired, the tray may be provided with metal "bounding" plates 42, which are permanently, slidably and tiltably supported on the support rods.

Figure 2:
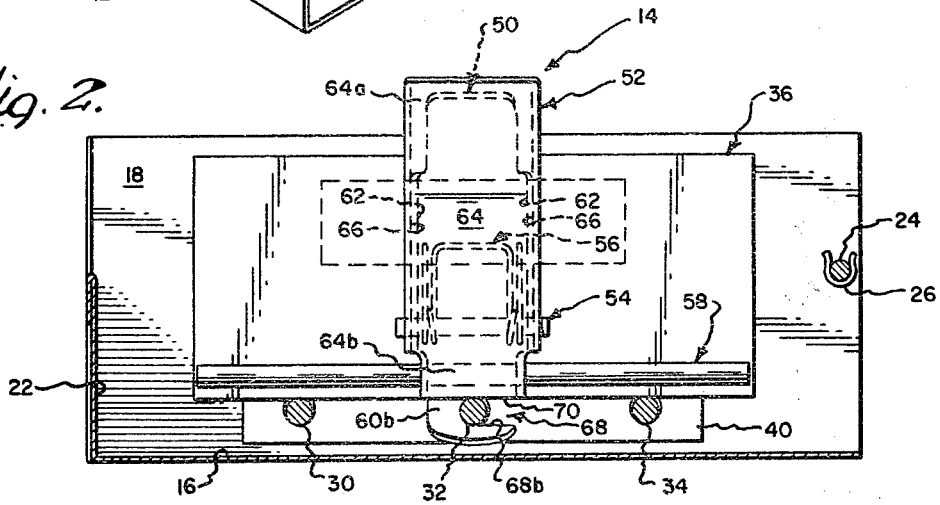
FIG. 2 is a sectional view taken generally along the line 2—2 in FIG. 1.
Figure 3:
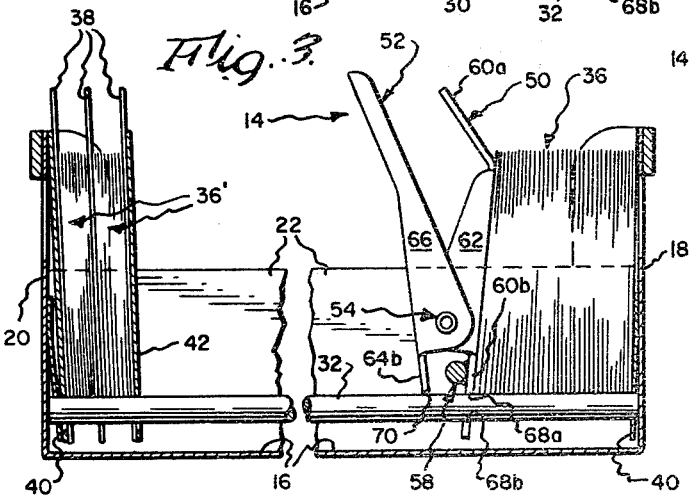
FIG. 3 is a sectional view taken generally along the line 3—3 in FIG. 1.
Figure 4:
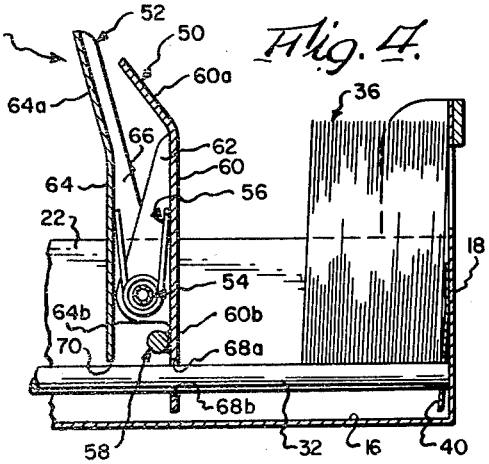
FIG. 4 is a sectional view taken generally along the line 4—4 in FIG. 1.

Compressor 14 is shown in FIGS. 1–4 as generally including first and second compressor parts 50 and 52; hinge means, such as a hinge pin 54, for joining compressor parts 50 and 52 for relative pivotal movement between their operative or clamping and inoperative or release position shown in FIGS. 3 and 4, respectively; resiliently deformable means, such as a spring 56, for normally biasing compressor parts 50 and 52 into their clamping positions; and an anti-tilt device, such as an elongated bar or rod 58 for constraining or limiting tilting movements of the compressor relative to the support rod on which it is supported. More specifically, first compressor part 50 is best shown in FIGS. 2–4 as being in the form of a generally U-shaped plate having a first connecting portion 60 formed with upper or operator and lower end portions **60*a* and 60*b*, respectively; and a pair of first leg portions 62. In a like manner, second compressor part 52 is formed from a generally U-shaped plate having a second connecting portion 64 formed with upper or operator and lower end portions 64*a* and 64*b*, respectively; and a pair of second leg portions 66. As will be apparent from viewing FIGS. 2–4, hinge pin 54 has its opposite ends received within aligned openings formed in first and second leg portions 62 and 66. Preferably, spring 56 is wound around hinge pin 54 and shaped to arrange its intermediate and end portions in bearing engagement with the inwardly facing surfaces of first and second connecting portions 60 and 64, respectively. Also, anti-tilt bar 58 is preferably fixed, as by welding to the inwardly facing surface of lower end portion 60*b* and disposed essentially parallel to the axis of hinge pin 54. When compressor 14 is to be used in combination with a three rod type support system, the compressor would be supported on centralmost support rod 32 and anti-tilt bar 58 sized to bridge across all of the support rods with its ends disposed equidistant from compressor parts 50 and 52**.

By again referring particularly to FIGS. 2–4, it will be understood that lower end portion **60*b* serves to define a first bearing means, which is preferably in the form of a side edge opening slot 68 having upper and lower bearing edges 68***a* and 68*b* adapted to frictionally engage with the upper and lower surfaces of centralmost support rod 32, respectively, whereas lower end portion 64*b* serves to define a second bearing means, such as may be defined by its lower marginal edge 70 adapted to frictionally engage with the upper surface of support rod 32.

When an operator desired to mount, remove or adjust compressor 14 relative to support rod 32, he would first apply finger pressure to the oppositely or outwardly facing surfaces of upper end portions 60*a* and 64*a* to a degree sufficient to pivot compressor parts 50 and 52 against the bias of spring 56 into their release positions shown in FIG. 4. If adjustment of compressor 14 lengthwise of support rod 32 is desired, the operator would then simply move the compressor to a desired position and then release upper end portions 60*a* and 64*a* in order to permit spring 56 to bias the compressor parts into their clamping positions shown in FIG. 3, wherein edge 68*a* underengages and edges 68*b* and 70 overengage support rod 32. In effect, engagement of edge 70 with the support rod serves to vertically tilt the compressor parts to a degree sufficient to bring edges 68*a* and 68*b* into frictional engagement with the support rod. When compressor parts 50 and 52 are disposed in their clamping position relative to support rod 32, anti-tilt bar 58 is disposed to overlie and bridge across rods 30, 32 and 34 in order to constrain or limit the degree of tilting movements of compressor 14 about the axis of support rod 32. Preferably, a small vertical spacing should exist between anti-tilt bar 58 and the support rods in order to facilitate adjustment of the compressor lengthwise of support rod 32, as well as insertion and removal of the compressor from the tray in the manner to be described.

Again making reference to FIG. 3, it will be noted that when the compressor parts are disposed in their clamping positions, their respective lower end portions 60*b* and 64*b* tilt or extend upwardly and relatively toward rear and front walls 18 and 20, respectively, such as to permit the compressor to be selectively employed to compress the file material adjacent the rear and front ends of the tray, as indicated in full and phantom line in FIG. 1.

When it is desired to remove compressor 14 from within tray 12 after first pivoting compressor parts 50 and 52 into their release positions shown in FIG. 4, the operator would simply move the compressor transversely of support rod 32 sufficiently to remove the support rod from within the confines of slot 68 and then lift the compressor to remove same from between support rods 30 and 32 and then from within the confines of the tray. Preferably, the widthwise dimension of lower end portion 60*b* would be less than the distance between support rods 30 and 32, so as to permit removal/insertion of the compressor without the requirement that anti-tilt bar 58 be tilted relative to a plane disposed normal to support rods 30, 32 and 34; this being particularly advantageous when the tray is substantially filled.

The present invention has been described with particular reference to a filing tray having a three support rod type filing system. However, it will be appreciated that the construction of compressor 14 may be modified to accommodate same for use in filing trays having support rods of a number other than three.

I claim:

1. In a filing system including a storage tray having a bottom wall, front and rear walls upstanding from front and rear ends of said bottom wall and at least three parallel support rods and supported by said front and rear walls and arranged in a spaced parallel relationship relative to said bottom wall; and a compressor for releasably engaging materials filed within said tray in engagement with said rods, the improvement wherein said compressor comprises in combination:

a first compressor part having an upper operator end portion and a lower end portion;

a second compressor part having an upper operator end portion and a lower end portion, said lower end portion of one of the compressor parts being formed with a slot bounded in part by upper and lower bearing edges, said slot opening at one end thereof and being sized to freely and removeably receive one of said rods, said lower end portion of the other of said compressor parts having a lower end bearing edge;

hinge means for joining said compressor parts for pivotal movement about a pivot axis for removeably mounting said compressor parts on said one rod with said upper and lower bearing edges disposed in frictional surface engagement with upper and lower surfaces of said one rod and with said lower end bearing edge disposed in frictional surface engagement with said upper surface of said one rod, said first and second compressor parts when mounted on said one rod being free to tilt about the axis thereof and have their lower end portions arranged to extend upwardly and towards said rear and front walls of said tray, respectively;

resiliently deformable means for normally maintaining said compressor parts mounted on said one rod; and anti-tilt means in a form of a bar fixed to one of said compressor parts to overlie and engage with other ones of said rods for limiting tilting movement of said compressor parts about the axis of said one rod when mounted thereon.

2. The improvement according to claim 1, wherein said slot opens through a vertically disclosed side edge of said lower end portion of said one of said compressor parts, and said lower end portion of said one of said compressor parts has a widthwise dimension less than the spacing between said one rod and another of said rods adjacent thereto.

3. The improvement according to claim 1, wherein said slot is formed in said first compressor part, said bar is fixed to said first compressor part, and said bar is arranged intermediate said first and second compressor parts and to extend essentially parallel to said pivot axis.

4. In a filing system including a storage tray having a bottom wall, front and rear walls upstanding from front and rear ends of said bottom wall and at least three parallel support rods end supported by said front and rear walls and arranged in spaced parallel relationship relative to said bottom wall; and a compressor for releaseably engaging materials filed within said tray in engagement with said rods, the improvement wherein said compressor comprises in combination:

a first compressor part in the form of a generally U-shaped plate having a first connecting portion and a pair of first leg portions, said first connecting portion having an upper operator end portion and a lower end portion, said lower end portion being formed with a slot bounded in part by upper and lower bearing edges, said slot opening through a vertical side edge of said lower end portion and being sized to freely receive one of said rods, and said lower end portion of said first connecting portion having a widthwise dimension less than the spacing between said one rod and another of said rods adjacent thereto;

a second compressor part in the form of a generally U-shaped plate having a second connecting portion and a pair of second leg portions, said second connecting portion having an upper operator end portion and a lower end portion having a lower end bearing edge;

hinge means received within aligned openings formed in said first and second leg portions for joining said first and second compressor parts for pivotal movement about a pivotal axis for removeably mounting said first and second compressor parts on said one rod with said upper and lower bearing edges disposed in frictional surface engagement with upper and lower surfaces of said one rod and with said lower end bearing edge disposed in frictional surface engagement with said upper surface of said one rod, said first and second compressor parts when mounted on said one rod being free to tilt about the axis thereof and having the lower end portions of their first and second connecting portions arranged to extend upwardly and towards said rear and upper walls of said tray, respectively;

spring means mounted on said hinge means for normally maintaining said first and second compressor parts mounted on said one rod; and anti-tilt means fixed to said first connecting portion to overlie and engage with other ones of said rods for limiting tilting movement of said first and second compressor parts about the axis of said one rod when mounted thereof, and said anti-tilt means being a bar arranged intermediate said first and second compressor parts and to extend essentially parallel to said pivotal axis.

* * * * *